US005678689A

United States Patent [19]

Clark et al.

[11] Patent Number: 5,678,689

[45] Date of Patent: Oct. 21, 1997

[54] TWO SIDE TAPING APPARATUS

[76] Inventors: Mary J. Clark; Ernest H. Clark, both of 2645 S. Westwood, Mesa, Ariz. 85210

[21] Appl. No.: 517,601

[22] Filed: Aug. 22, 1995

[51] Int. Cl.[6] ..... B65D 85/67

[52] U.S. Cl. ..... 206/408; 206/411; 242/55.53; 242/59

[58] Field of Search ..... 206/389, 391, 206/397, 398, 402, 408, 411, 409; 242/55.2, 55.53, 56 R, 56.8, 58, 59

[56] References Cited

U.S. PATENT DOCUMENTS

| | | | |
|---|---|---|---|
| 666,261 | 1/1901 | Butterworth . | |
| 2,647,577 | 11/1953 | White | 164/84.5 |
| 2,657,795 | 11/1953 | Calabrese | 206/59 |
| 3,302,781 | 2/1967 | Rudnick | 206/58 |
| 3,403,869 | 10/1968 | Marchisen et al. | 206/408 X |
| 4,060,444 | 11/1977 | Schweig, Jr. et al. | 156/391 |
| 4,531,634 | 7/1985 | Jung-Chi | 206/391 |
| 4,546,879 | 10/1985 | Viscasillas | 206/391 |
| 4,817,798 | 4/1989 | Huang | 206/408 X |
| 5,358,113 | 10/1994 | Hellenbrand | 206/411 |

*Primary Examiner*—Jacob K. Ackun
*Attorney, Agent, or Firm*—Snell & Wilmer L.L.P.

[57] ABSTRACT

A taping apparatus is presented for simultaneously taping opposing sides of a thin planar object around an edge of the thin planar object. The apparatus includes a tapered trough which functions as a track for advancing the tape and thin planar object through a pincher assembly which secures the tape to opposing sides of the object by applying pressure. The apparatus is designed to be hand held during use. Other embodiments of the apparatus eliminate the need to hold the apparatus during use.

23 Claims, 4 Drawing Sheets

TWO SIDE TAPING APPARATUS

BACKGROUND OF THE INVENTION

The present invention relates generally to a two side taping device. More particularly, the present invention relates to a taping apparatus that can simultaneously tape both sides of the edge of a paper or material by folding the tape around the edge of the paper or material.

A variety of tape dispensers are known in the prior art. For example, U.S. Pat. No. 4,531,634 describes an instant VELCRO assembly having a male tape roll and female tape roll of VELCRO which are rolled up separately and packed together in one plastic case. A short terminal part of each of the rolls are pressed together and pulled out of an outlet in the middle portion of the case so that the male and female VELCRO portions are pressed together automatically as they are pulled from the case. The matched male and female VELCRO tapes can then be cut at any length. Further, U.S. Pat. No. 4,546,879 describes a tape dispenser for feeding two interengageable tapes out of a common slot. The tape dispenser includes a hollow elongated container which holds two spirally wound dispensing tapes that have specially prepared surfaces for releasable adhesion to one another. The end portions of the tape are interengaged along adjacent surfaces and project through a slot contained within the container.

Another patent, U.S. Pat. No. 4,060,444 discloses a tape applicator operable with one hand and having a frame with a rotatable mandrel for mounting one or more rolls of adhesive tape. The frame is made of a paperboard and includes a flat elongated portion which the tape passes under in order to positively and firmly apply the tape to a selected surface as the applicator moves over the surface. The frame also includes guides located at its ends for tape strips which are fed from tape rolls. The guides insure accuracy in application and equidistant spacing between multiple tape strips. The guides also act as a means for removing any lining as the tape is applied.

Rolls of adhesive tape which are uniquely designed for specific applications are also disclosed in the prior art. For example, U.S. Pat. No. 666,261 describes a coil of adhesive stay-tape having a longitudinal crease or groove formed within it. The purpose of this specifically designed tape is to aid and accurately guide the tape when applying the tape to box corners. Further, U.S. Pat. No. 2,657,795 discloses a roll of pressure-sensitive adhesive striping tape for masking surfaces prior to painting stripes or similar designs. The tape roll consists of a series of three, five, or a higher odd number of contiguous individual strips of masking tape which are wound on a single core. The individual strips are cohered together along their contiguous edges so that the strips are held in an edge-two-edge relationship during unwinding from the roll and application of the tape to a surface. The strips are separated after application of the tape by stripping away a central strip of the tape.

Presently, if an individual desires to have a paper, fabric or other material taped on both sides around its edges, one must apply half the width of a strip of tape to one side of the material near its edge, fold the strip of tape over the edge of material, and apply the other half width of the strip of tape to the opposing side of the material. Although one of the prior art references is directed to a tape roll comprising a tape configuration that assists in applying a single strip of tape to opposing surfaces, no device is disclosed which functions to apply a strip of tape simultaneously to two opposing sides of an edge of a paper, fabric, or other thin material. Such a two side taping device has a number of uses including sealing unintentionally opened envelopes, and taping around the edges of a variety of items including blue prints, fabrics which are used for craft stitching and regular sewing, and papers and folders for creating reinforced file systems.

Accordingly, there is a need for a simply constructed device which enables a user to tape over the edge of a paper, fabric, or other thin material such that the tape extends from one side near the edge of the material to be taped, over the edge of the material, and onto the opposing side near the edge of the material. The device should preferably be operable with one hand to allow a user to manipulate the material to be taped with the other hand, or alternatively, the operation of the device should be hands-free.

SUMMARY OF THE INVENTION

It is a principal object of the present invention to provide an apparatus which can tape opposing sides of a thin material, such as paper, cardboard, fabric, etc., around its edges.

It is a further object of the present invention to provide an apparatus for simultaneously taping opposing sides of a thin object or material around its edge or edges wherein one strip of tape is used that is wrapped around the edge or edges of the thin object or material.

It is a still further object of the present invention to provide a hand held apparatus for taping opposing sides of a thin object around its edges wherein, during use, the apparatus is held with one hand and the object is held with the other hand.

It is a yet a further object of the present invention to provide a hands-free apparatus for taping opposing sides of a thin object around its edges.

It is a still further object of the present invention to provide a simply constructed apparatus for simultaneously taping opposing sides of a thin object or material around its edge or edges which is safe and easy to use, and cost effective to manufacture.

In brief, the two side taping apparatus for simultaneously taping opposing sides of a thin object or material around its edges includes a housing having a means for releasably engaging at least one roll of tape therein and a track contained within the housing which is accessible to the tape roll such that the tape can be dispensed along the length of the track as it is being unrolled. More specifically, the two side taping apparatus for simultaneously taping two sides of an object around its edges includes a housing having a top end and a bottom end, a means for releasably engaging at least one roll of tape located between the top and bottom ends of the housing, and a track located along the length of the top end of the housing for dispensing tape from the tape roll wherein the track is tapered in width along its length. The two side taping apparatus also preferably includes a means for cutting the tape located at the end of the track having the narrowmost width.

The two side taping apparatus may be hand held or may be operable hands free depending upon its configuration. The hands free apparatus includes a weighted base or clamp for stabilizing the apparatus against a horizontal or vertical surface. Alternatively, VELCRO may be used to attach the apparatus to a surface wherein male and female strips of VELCRO are attached to the bottom of the apparatus and a horizontal or vertical securing surface, respectively.

The objects and advantages of this invention will appear more fully from the following more detailed description of the preferred embodiments of the invention made in conjunction with the accompanying drawings.

DETAILED DESCRIPTION OF THE PREFERRED EMBODIMENTS

Figure 1:
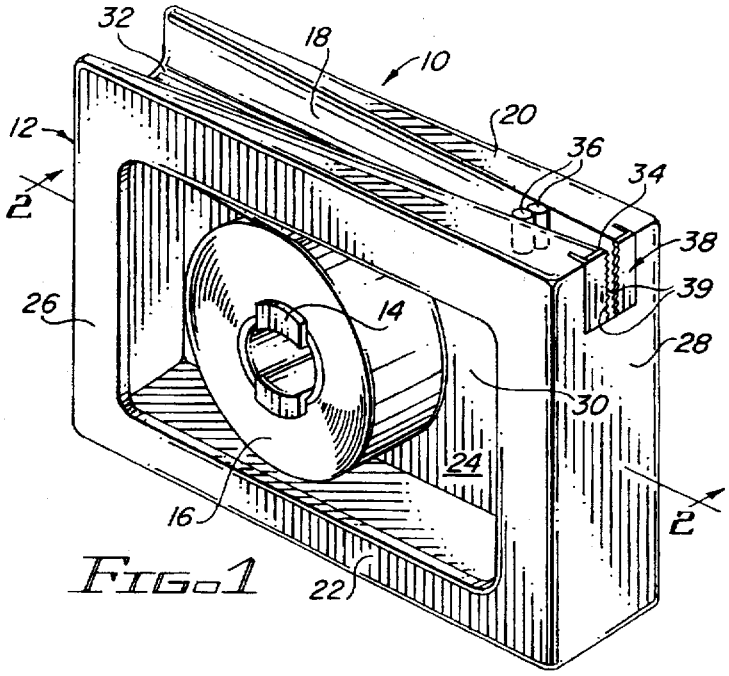
FIG. 1 is a perspective view of a first preferred embodiment of the two side taping apparatus for simultaneously taping opposing sides of an object around its edges in accordance with the present invention.

Turning now to the first preferred embodiment of the present invention with reference to FIG. 1, the two side taping apparatus 10 of the present invention includes a housing member 12, a tape roll holder 14 contained within the housing member 12 for retaining a roll of tape 16, a tapered trough 18 located along a length of the housing member 12, and a means for tape dispensed from the tape roll 16 to access the tapered trough 18. The housing member 12 comprises a top end 20, a bottom end 22, a back side 24, a front side 26, and two opposing side ends 28. The front side 26 contains an opening 30 which provides access to the tape roll holder 14 and the tape roll 16 so that the tape roll 16 can be easily replaced once it becomes empty.

The tapered trough 18 comprises a trough having a first end 32, a second opposite end 34, and a gradually narrowing width that runs along the top length of the housing member 12. The first end 32 of the tapered trough 18 has a width that is approximately equal to the width of the housing member 12. The width of the tapered trough 18 then gradually narrows along its length and concludes at its second opposite end 34 which has a very narrow width that is preferably slightly wider than the width of a heavy cardboard or paperboard. Further, there are a pair of pinch rollers 36 (more clearly shown in FIG. 19B) which are at least partially positioned within the tapered trough 18 such that their external surfaces 37 come in partial contact with one another as they turn about a vertical axis.

The pinch rollers 36 comprise one embodiment of the pincher assembly contained within the two side taping apparatus which functions to press and secure the adhesive side of the tape to opposite sides of an object or material.

Another embodiment of the pincher assembly is described later with reference to FIG. 19A.

During use of the two side taping apparatus 10, the pinch roller assemblies 36 function to squeeze the tape which has been dispensed along the tapered trough 18 against the opposite sides of the paper or other thin object whose edge has been forwarded along the track with the dispensed tape. Once the pinch roller assemblies 36 have aided in firmly securing the tape along the opposite sides of the entire length of an edge of the paper, the tape is forced against the edges of a tape cutter 38 which is located at the second opposite end 34 of the tapered trough 18.

The tape cutter 38 may comprise various configurations including, but not limited to, one or more sets of sharp jagged teeth 39 positioned at the second opposite end 34 of the tapered trough 18 as shown in FIG. 1, one or more sharp metal blades positioned at the second opposite end 34 of the tapered trough 18 (See FIG. 19), or a single retractable blade connected to the front or back side 26,24 near the top end 20 of the housing member 12 closest to the second opposite end 34 of the tapered trough 18 so that the tape can be forced against the edge of the blade thereby severing the tape.

Figure 2:
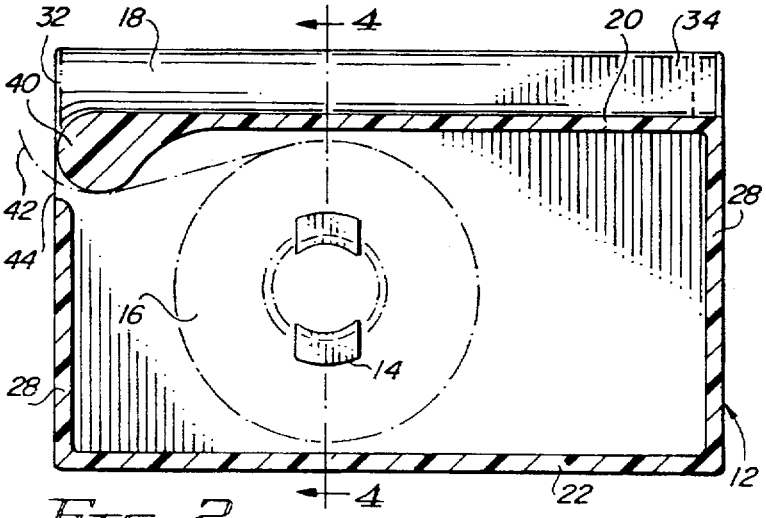
FIG. 2 is a cross-sectional view of the two side taping apparatus taken along line 2—2 of FIG. 1.

FIG. 2 illustrates a cross-sectional view of the two side taping apparatus 10 of the present invention taken along line 2—2 of FIG. 1. The roll of tape 16 is shown in phantom as it is contained within the housing member 12. The top end 20, bottom end 22, and opposing side ends 28 of the housing member 12 are shown. The tapered trough 18 is shown positioned along the length of the top end 20 of the housing member 12. The tapered trough 18 may be placed and secured directly onto the top end 20 of the housing member 12 or, alternatively, the tapered trough 18 may be integrally formed within the top end 20 of the housing member 12. A tape guide member 40 is positioned within the housing member 12 underneath the tapered trough 18 near the first end of the tapered trough 18 which comprises the widest width of the tapered trough 18. During use of the two side taping apparatus 10, tape 42 is dispensed from the roll of tape 16 by being pulled with its adhesive side facing downward around the tape guide member 40, through a slot 44 contained in a side end 28 of the housing member 12, onto the bottom of the first end 32 of the tapered trough 18 with its adhesive side facing upward, along the bottom of the tapered trough 18, through the pinch rollers 36, and out through the second opposite end 34 of the tapered trough 18.

Figure 3:
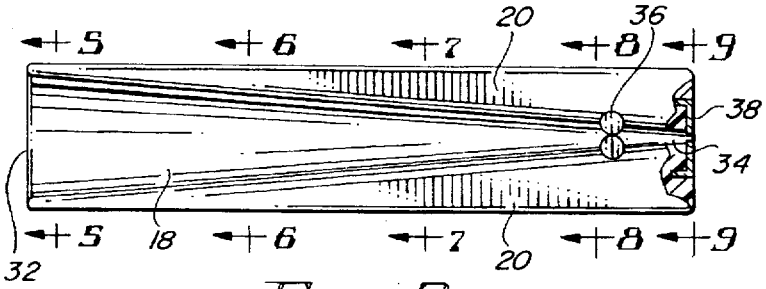
FIG. 3 is a top elevational view of the two side taping apparatus illustrated in FIG. 1 which shows the tapered trough that runs along the top length of the apparatus.

A top elevational view of the tapered trough 18 is shown in FIG. 3. As previously described, the tapered trough 18 comprises a first end 32 having a width which is approximately equal to the width of the top end 20 of the housing member 12 and a second opposite end 34 having a width that is slightly greater than the width of a heavy paperboard or cardboard. The width of the tapered trough 18 gradually and uniformly decreases from the first end 32 to the second opposite end 34. Further, a pair of pinch rollers 36 or pincher arms (See FIG. 19A) are at least partially positioned within the tapered trough 18 near its second opposite end 34. The pair of pinch rollers 36 are preferably mounted on a spring loaded moveable track such as those commonly known in the prior art so that they are capable of allowing a predetermined range of widths or thicknesses to pass therethrough while assisting in pressing and securing the tape to opposite sides of a paper or thin object.

Figure 4:
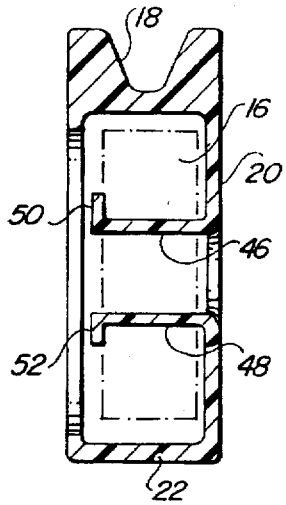
FIG. 4 is a cross-sectional view of the two-sided taping apparatus taken along line 4—4 of FIG. 2 which shows the elements which comprise one embodiment of the tape roll holder contained within the apparatus.

A cross-section taken along the width of the two side taping apparatus 10 is shown in FIG. 4 to illustrate the tape roll holder 14 contained within the apparatus. The tape roll holder 14 is positioned near a center of the housing member 12. The tape roll holder 12 comprises first and second arm members 46,48, each of which terminate in first and second shorter arm members 50,52, respectively, which are connected to the first and second arm members 46,48 such that they project in opposite directions from the first and second arm members 46,48. The first and second arm members 46,48 are secured to the back side 20 of the housing member 12. To secure or remove a roll of tape 16 within the housing member 12, the first and second shorter arm members 50,52 are pressed toward one another to allow a tape role to slide over the first and second shorter arm members 50,52. Once a new tape roll is placed over the first and second shorter arm members 50,52, pressure on the first and second shorter arm members 50,52 is released and they return to their normal separation distance. The tape roll 16 is then secured and retained within the "L" shaped hook that is formed by the joinder of the first and second arm members 46,48 to the first and second shorter arm members 50,52, respectively.

Figure 5:
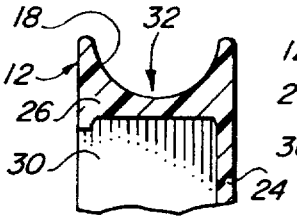
FIG. 5 is a cross-sectional view of the tapered trough shown in FIG. 3 taken along line 5—5 of FIG. 3.
Figure 6:
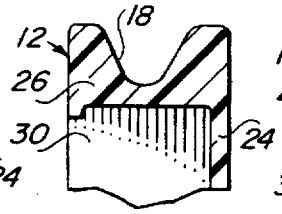
FIG. 6 is a cross-sectional view of the tapered trough shown in FIG. 3 taken along line 6—6 of FIG. 3.
Figure 7:
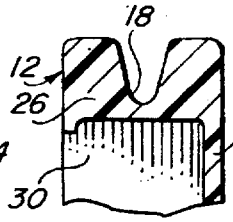
FIG. 7 is a cross-sectional view of the tapered trough shown in FIG. 3 taken along line 7—7 of FIG. 3.
Figure 8:
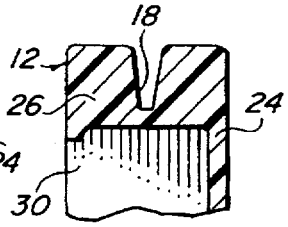
FIG. 8 is a cross-sectional view of the tapered trough shown in FIG. 3 taken along line 8—8 of FIG. 3.
Figure 9:
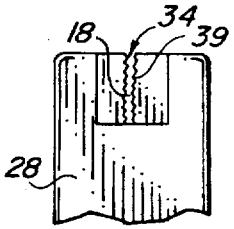
FIG. 9 is an end elevational view of the tapered trough shown in FIG. 3 take along line 9—9 of FIG. 3 showing a first embodiment of the tape cutter positioned at the narrowmost end of the trough.

A series of cross-sectional views that depict the uniform narrowing of the width of the tapered trough 18 are shown in FIGS. 5 through 9. FIGS. 5 through 9 show the tapered trough 18 as being an integrally formed part of the housing member 12. FIG. 5 shows the first end 32 of the tapered trough 18 which comprises the widest width of the tapered trough 18 along its entire length. During use of the two side taping apparatus 10, both the dispensed tape and the paper or object to be simultaneously taped on opposing sides are advanced along the length of the tapered trough 18 starting at this first end 32 of the tapered trough 18. FIGS. 6 through 8 show the gradual uniform narrowing of the tapered trough 18 which advances from a generally "U" or "V" shaped trough to a narrow "V" shaped trough. FIG. 9 illustrates the end elevational view of the tapered trough 18 at its second opposite end 34 showing the tape cutter 38, comprising two rows of jagged teeth 39, contained at the narrowmost end of the tapered trough 18. The pair of pinch rollers 36 which are at least partially contained within the tapered trough 18 are located between the widths of the tapered trough depicted in FIGS. 8 and 11.

Figure 10:
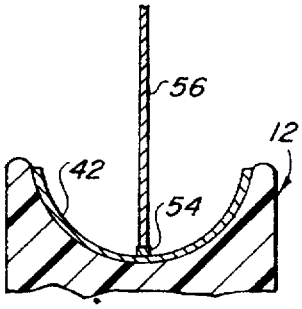
FIG. 10 is a cross-sectional view of the tapered trough near its widest width shown during use of the two side taping apparatus of the present invention.
Figure 11:
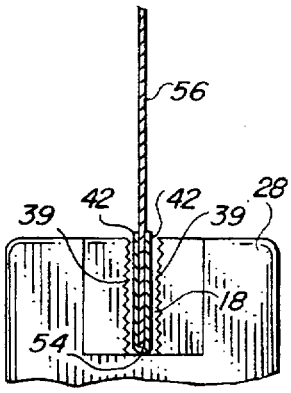
FIG. 11 is an end view of the tapered trough at its narrowmost end and the tape cutter shown during use of the two side taping apparatus of the present invention.

Referring now to FIG. 10, there is shown a cross section of the tapered trough 18 similar to that shown in FIG. 5 where the two side taping apparatus 10 is in use. The tape 42 is dispensed from the tape roll, fed around the tape guide member 40 (See FIG. 2) and through the slot 44 in the side end 28 of the housing member, and positioned at the bottom of the first end 32 of the tapered trough 18 with its adhesive side facing upward. An edge 54 of a sheet of paper 56 or other thin object is then placed in the tapered trough 18. The paper 56 or object is advanced along the length of the tapered trough 18 and through the pair of pinch rollers 36 or other pincher assembly (See FIG. 19A). FIG. 11 shows an end elevational view of the tapered trough 18 at its second opposite end 34 similar to that depicted in FIG. 9. At this point, the tape 42 has been pressed against the opposite sides of the paper 56 or object around its edge 54. The paper 56 or object having two sided taping about its edge 54 is then advanced through the second opposite end 34 of the tapered trough 18. Once the paper 56 or object has cleared the second opposite end 34 of the tapered trough 18, the tape 42 is forced against a set of teeth 39 located at the second opposite end 34 of the tapered trough 18 to sever the tape 42 near the end of the paper 56 or object.

The two side taping device 10 may prove to work more effectively and efficiently by first guiding the tape 42 through the entire tapered trough 18 and out its second opposite end 34 prior to positioning a paper or thin object at the first end 32 of the tapered trough 18 and advancing it through the tapered trough 18. This method may prove to work better due to the fact that the tape 42 has been secured to itself at the second opposite end 34 of the tapered trough 18 and therefore can function as a tab to assist in pulling or advancing the paper or thin object forward along the length of the tapered trough 18. The tapered trough 18 is designed to act as a track for advancing the paper or thin object as it is being simultaneously taped on opposite sides about one of its edges.

Figure 12:
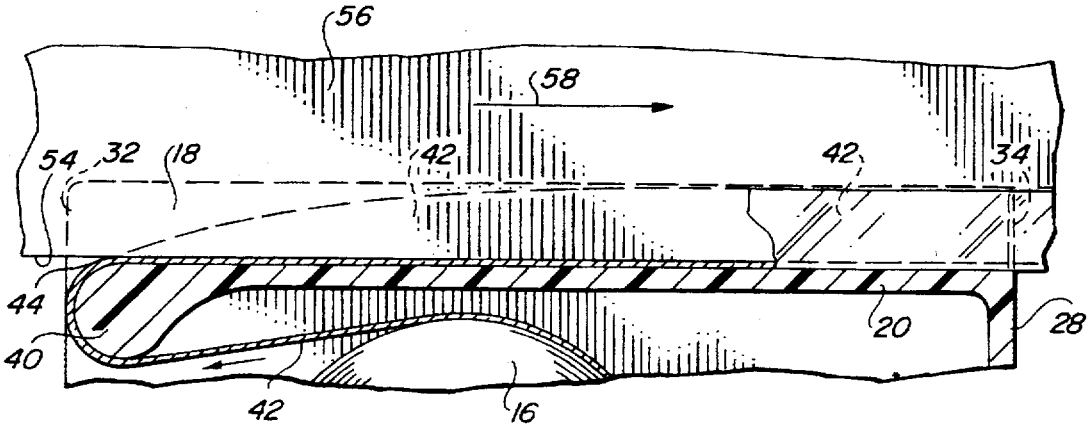
FIG. 12 is a partial cross sectional view of the top portion of the first preferred embodiment of the two side taping apparatus of the present invention taken along its length during use to show the path and placement of the tape onto a piece of paper as it simultaneously tapes opposing sides around an edge of the paper.

A cross sectional view of the top portion of the two side taping apparatus of the present invention taken along its length during use to show the path and placement of the tape onto a piece of paper as it simultaneously tapes opposing sides around an edge of the paper is shown in FIG. 12. The tape 42 is drawn from the tape roll 16 with the adhesive side facing downward and fed around the tape guide member 40. The tape 42 is then fed through a slot 44 in the housing member which may be located through a side end 28 or, alternatively, through the bottom of the tapered trough 18 near its first end 32 (See FIG. 20). After the tape 42 is fed around the tape guide member 40, through the slot 44, and onto the bottom surface of the tapered trough 18, the tape's adhesive side is facing upward. The edge 54 of the paper 56 which is to be edged with tape 42 is then placed onto the tape 42 and fed along the track made by the tapered trough 18 starting at the first end 32 of the tapered trough 18. The paper 56 and tape 42 are moved forward in the direction of the arrow 58 until the end of the paper 58 has passed across the second opposite end 34 of the tapered trough 18. FIG. 12 shows the tape 42 gradually folding upward along the length of the edge 54 of the paper 56. The tape 42 is just beginning to fold upward in the tapered trough 18 near the first end 32 of the tapered trough 18 and the tape is completely folded in half with equal portions adhering to opposite sides of the paper 56 near the second opposite end 34 of the tapered trough 18.

Figure 13:
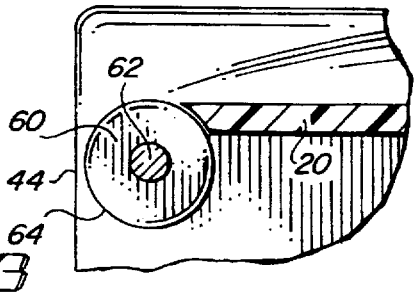
FIG. 13 is a partial cross-sectional view taken along the length of the first preferred embodiment of the two side taping apparatus showing the top portion of the apparatus near the widest end of the trough to illustrate another embodiment of the tape guide member contained within the two side taping apparatus.

An alternative embodiment of the tape guide member 40 is shown in FIG. 13. FIG. 13 shows a partial cross-sectional view taken along the length of the two side taping apparatus 10 showing the top portion of the apparatus 10 near the first and widest end 32 of the tapered trough 18. The second embodiment of the tape guide member 40 includes a cylindrical roller 60 which is mounted on a post 62 such that it rotates freely about the post 62. The cylindrical roller 60 rotates about the post 62 as the tape 42 is fed over the exterior surface of the cylindrical roller 60 thereby aiding in the feeding of the tape 42 through the slot 44 and onto the bottom surface of the tapered trough 18.

Figure 14:
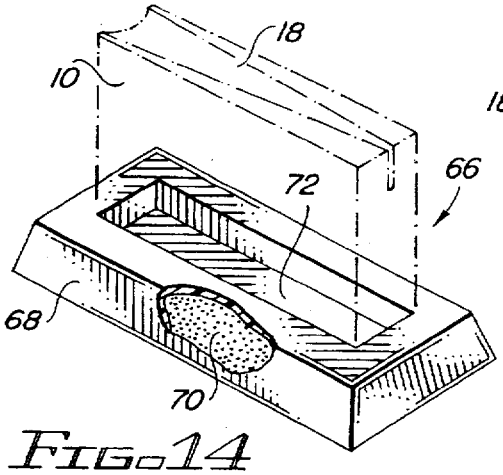
FIG. 14 is a perspective view of a base member which comprises part of a hands free operable embodiment of the two side taping apparatus of the present invention with the vertical use of the two side taping apparatus shown in phantom and a portion of the base member shown cut away.

The two side taping apparatus 10 shown in the previously described figures is designed to be operated while being hand held. During use, one hand of the user holds the two side taping apparatus and the user's other hand is used to draw the tape and paper through the tapered trough 18 contained within the apparatus 10. FIG. 14 is a perspective view of a base member which comprises part of a hands free operable embodiment 66 of the two side taping apparatus 10 of the present invention.

The hands free operable embodiment 66 of the two side taping apparatus comprises the two side taping apparatus 10, shown in phantom, and a base member 68 wherein the two side taping apparatus 10 is vertically connected to the base member 68 such that the tapered trough 18 faces upward relative to the base member 68. The base member 68 may be filled with sand 70 or some other weighted material in order to stabilize the embodiment of the apparatus on a planar surface such as a table or work bench. The base member 68 is preferably longer and wider than the hand held two side taping apparatus 10 so that it can accomplish its function of stabilizing the apparatus against a planar surface so that a user can use the hands free operable embodiment 66 of the apparatus without needing to hold the apparatus. Further, the base member 68 may comprise an indented area 72 for the placement and connection of the hand held two side taping apparatus 10 to further stabilize the second embodiment 66 of the apparatus. The hand held two side taping apparatus 10 may be permanently secured or releasably connected to the base member 68.

Figure 15:
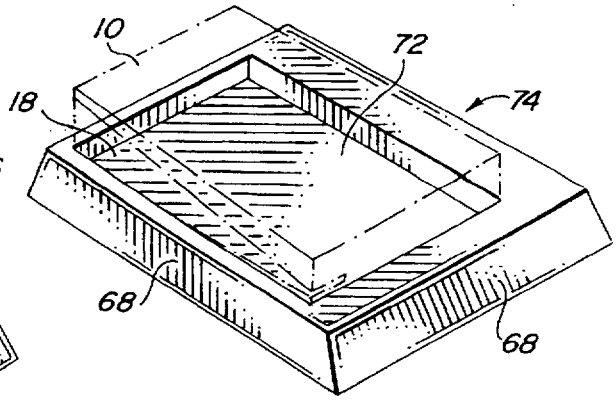
FIG. 15 is a perspective view of a second embodiment of the base member which comprises part of the hands free operable embodiment of the two side taping apparatus of the present invention with the horizontal use of the two side taping apparatus shown in phantom.

A second hands free operable embodiment 74 of the two side taping apparatus is shown in FIG. 15. This embodiment 74 of the two side taping apparatus includes the preferred hand held embodiment of the two side taping apparatus 10, shown in phantom, and a base member 68 wherein the two side taping apparatus 10 is horizontally connected to the base member 68 such that the tapered trough 18 faces sideways relative to the base member 68. Like the base member 68 in the other hands free operable embodiment 66, the base member 68 in this second embodiment 74 includes an indented area for the placement and connection of the preferred hand held embodiment of the two side taping apparatus 10. However, this second embodiment 74 of the apparatus allows even greater stability in that the center of gravity of the apparatus is substantially lowered thereby making it less likely to tip during use. Like the other hands free operable embodiment 66, the hand held two side taping apparatus 10 in this second embodiment 74 may be permanently secured or releasably connected to the base member 68.

Figure 16:
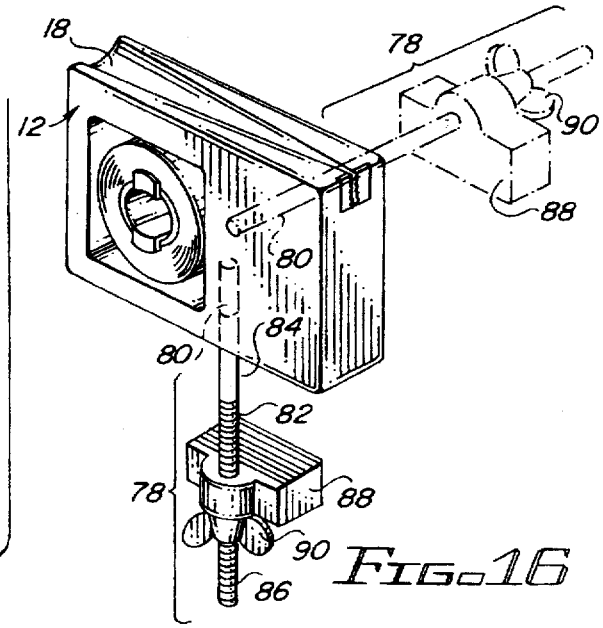
FIG. 16 is a perspective view of means for attaching and stabilizing the two side taping apparatus of the present invention to comprise a hands free operable embodiment which includes a first clamp member for vertically securing the two side taping apparatus to a planar surface and a second clamp member shown in phantom for horizontally securing the two side taping apparatus to a planar surface.

Finally, a third hands free operable embodiment 76 of the two side taping apparatus is shown in FIG. 16. The third embodiment 76 comprises the preferred hand held embodiment of the two side taping apparatus 10, a clamp means 78 for connecting the preferred hand held embodiment 10 to a planar surface, and a means for attaching the preferred hand held embodiment 10 to the clamp means 78 such as a circular hole 80 which has been bored through the housing 12 of the preferred hand held embodiment 10 for receiving the clamp means 78. The circular hole 80 may be bored through the bottom end 22 of the housing 12 in order to clamp the preferred hand held embodiment 10 in vertical association with a planar surface such that the tapered trough 18 faces upward from the planar surface. Alternatively, the circular hole 80 may be bored through the back side 24 of the housing 12 in order to clamp the preferred hand held embodiment 10 in a horizontal association with a planar surface such that the tapered trough 18 faces sideways relative to the planar surface. The clamp associated with this horizontal relationship to the planar surface is shown in phantom.

The clamp means comprises the standard elements of those clamp means which are prevalent in the prior art, namely a bolt 82 having a smooth end 84 and a scored end 86, a support element 88 which is placed adjacent the planar surface wherein the planar surface lies between the apparatus 10 and the support element 88, and a wing nut 90 for securing the support element 88 against the planar surface.

Figure 17:
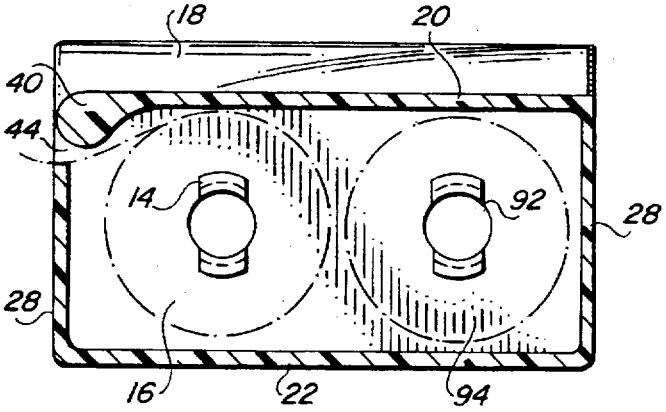
FIG. 17 is a cross sectional view of the first preferred embodiment of the two side taping apparatus of the present invention taken along a length of the apparatus showing a second tape roll holder for storing an additional roll of tape.
Figure 18:
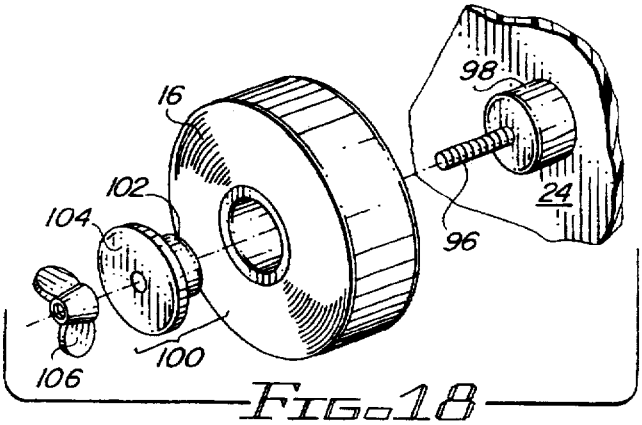
FIG. 18 is an exploded perspective view of a second embodiment of the tape roll holder contained within the housing of the first preferred embodiment of the two side taping apparatus of the present invention.

FIG. 17 is a cross sectional view of the first preferred embodiment of the two side taping apparatus 10 of the present invention taken along a length of the apparatus showing a second tape roll holder 92 for storing an additional roll of tape 94. When the first tape roll 16 is depleted, the additional roll of tape 94 can be removed from the second tape roll holder 92 and placed onto the first tape roll holder 14. The second tape roll holder 92 is comprised of the same components and functions in the same way as the first tape roll holder 14. However, another embodiment for the first and second tape roll holders 14,92 is shown in exploded view in FIG. 18.

The alternative embodiment of the tape roll holder includes a screw member 96 that is secured to the back side 24 of the housing member 12, a first ring member 98 placed upon the screw member 96, which is slightly larger than the diameter of the center opening in the tape roll 16, and secured to the back side 24 of the housing member 12, a second ring member 100 which comprises a first cylinder 102 having a diameter sized to accommodate a roll of tape 16 and a second cylinder 104 attached to the first cylinder 102 having a slightly larger diameter than the first cylinder 102, and a second wing nut 106. In use, the tape roll 16 is placed against the first ring member 98, the second ring member 100 is placed against the opposite side of the tape roll 16 such that the first cylinder 102 is retained within the center opening of the tape roll 16 and the second cylinder 104 lies adjacent the exterior side surface of the tape roll 16, and the second wing nut 106 is wound onto the screw member 96 to secure the tape roll 16 against the first ring member 98 while still allowing the tape roll 16 to rotate freely about the first cylinder 102 of the second ring member 100.

Figure 19B:
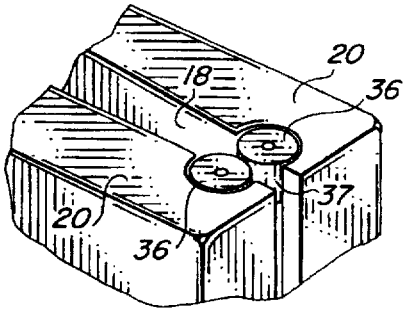
FIG. 19B is a perspective view of a second embodiment of the pincher assembly contained within the two side taping apparatus of the present invention.
Figure 19A:
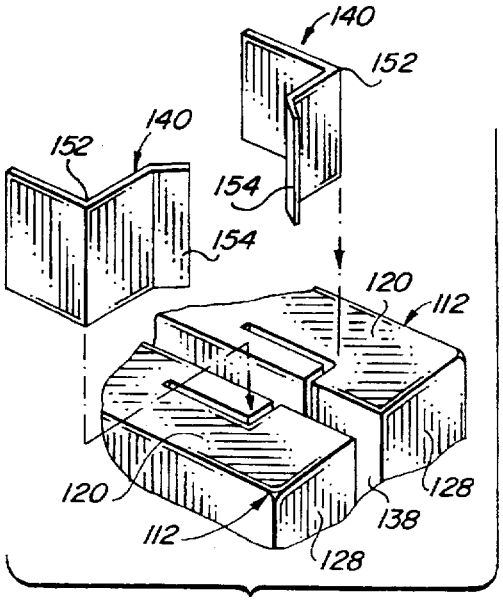
FIG. 19A is an exploded perspective view of a first embodiment of the pincher assembly contained within the two side taping apparatus of the present invention.
Figure 19:
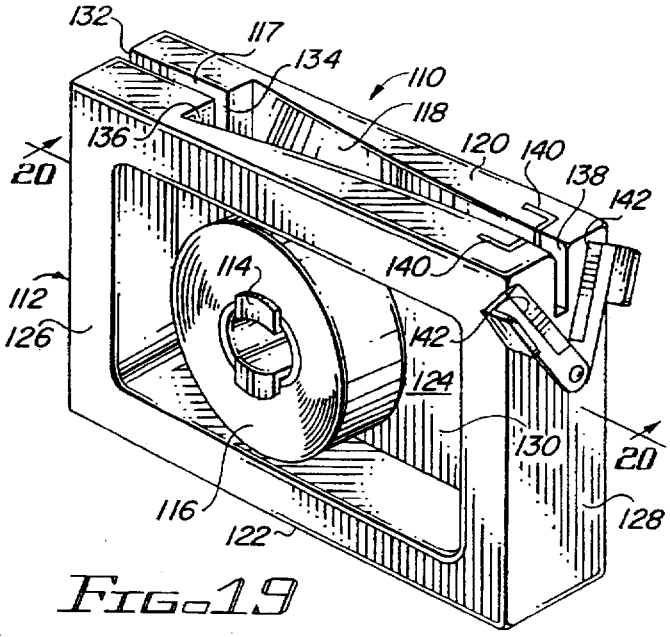
FIG. 19 is a perspective view of a second preferred embodiment of the two side taping apparatus for simultaneously taping opposing sides of an object around its edges in accordance with the present invention.

Turning now to FIG. 19, there is shown a second preferred embodiment 110 of the hand held two side taping apparatus of the present invention. The second preferred embodiment of the apparatus 110 includes a housing member 112, a tape roll holder 114 contained within the housing member 112 for retaining a roll of tape 116, a slit 117 for inserting an object such as a sheet of paper or fabric, a tapered trough 118 connected to the slit 117, and means for the tape dispensed from the tape roll 116 to access the tapered trough 118.

The housing member 112 comprises a top end 120, a bottom end 122, a back side 124, a front side 126, and two opposing side ends 128. The front side 126 contains an opening 130 which provides access to the tape roll holder 114 and the tape roll 116 so that the tape roll 116 can be easily replaced once it becomes empty.

The slit 117 comprises a first end 132 which begins at one opposing side 128 of the top end 120 of the housing 112 and a second end 134 which terminates within the top end 120 of the housing at the beginning of the tapered trough 118. The slit 117 ia approximately one quarter of the length of the top end 120 of the housing 112. The widest most portion of the tapered trough 118 begins where the slit 117 ends. The tapered trough 18 comprises a first end 136, which begins at the second end 134 of the slit, and a second end 138 which ends at the side end 128 of the housing 112 that is opposite the side end 128 of the housing 112 where the slit 117 begins. The first end 136 of the tapered trough 118 has a width that is almost as large as the width of the housing member 112. The width of the tapered trough 118 then gradually narrows along its length and concludes at its second end 138 which has a very narrow width.

A pair of pincher arms 140 are at least partially positioned within the tapered trough 118 such that they are capable of squeezing the tape which has been dispensed along the tapered trough 118 against opposite sides of the paper or other thin object whose edge has been forwarded through the slit 117 and along the track that is formed by the tapered trough 118. Once the pincher arms 140 have aided in firmly securing the tape along the opposite sides of the entire length of an edge of the paper and the paper has cleared the second end 138 of the tapered trough 118, opposing scissor type blades 142 are pinched together to cut the tape.

Figure 23:
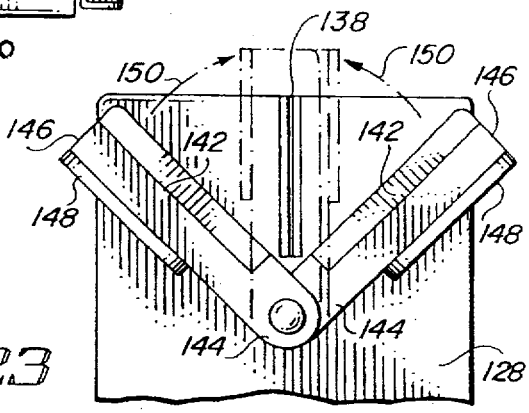
FIG. 23 is an end view of the second preferred embodiment of the two side taping apparatus of the present invention showing a second embodiment of the tape cutter positioned at the narrowmost end of the trough.

The opposing scissor type blades 142 that comprise the tape cutter are detailed in FIG. 23. Each opposing scissor type blade 142 comprises a first end 144, a second end 146, and a tab member 148 which is attached to the blade opposite its sharp end to form a means for pressing the scissor type blades 142 together. The scissor type blades 142 are pivotally connected at their first ends 144 to allow the tab members 148 to be pushed toward one another in the direction of the arrows 150 thereby enabling the blades 142 to come together in a scissor like fashion and cut the tape.

FIG. 19A is an exploded perspective view of the pincher arms 140 positioned within the tapered trough 118. Each pincher arm 140 comprises an "L" shaped arm portion 152 which is seated within the top end 120 of the housing member 112 and an angled arm portion 154 attached to the "L" shaped arm portion 152 which is positioned and retained within the tapered trough 118 such that the unattached ends 156 of the angled arm portions 154 barely touch one another as they sit within the tapered trough 118 near its narrowmost end. The pincher arms 140 are preferably comprised of acetate or a similar substance which will allow the angled arm portions 154 to slightly flex thereby allowing the tape and edge of the paper to pass through them while still exerting adequate pressure to secure the tape to the paper.

An alternative embodiment for the pincher assembly is shown in FIG. 19B. This embodiment comprises a pair of pinch rollers which were previously described with reference to the first preferred embodiment of the hand held two side taping apparatus 10 shown in FIG. 1.

Figure 20:
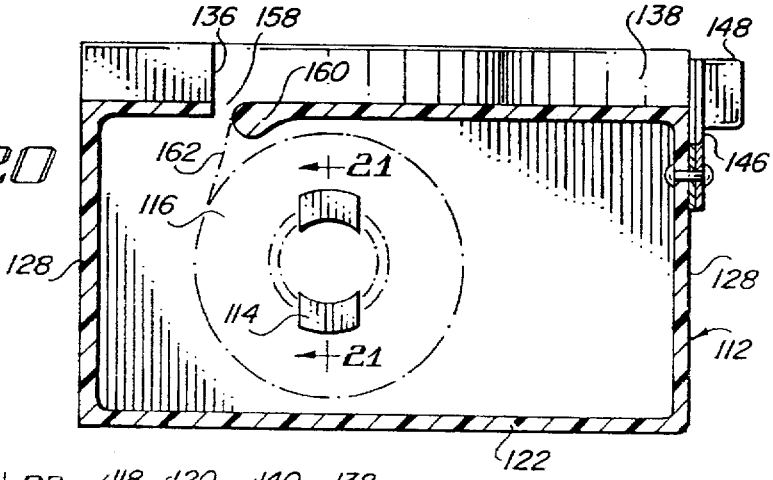
FIG. 20 is a cross-sectional view of the second preferred embodiment of the two side taping apparatus of the present invention taken along line 20—20 of FIG. 19.

FIG. 20 illustrates a cross-sectional view of the second-preferred embodiment of the two-side taping apparatus taken along line 20—20 of FIG. 19. The roll of tape 116 is shown in phantom as it is contained within the housing member 112. The top end 120, bottom end 122, and opposing side ends 128 of the housing member 112 are shown. The slit 117 and tapered trough 118 are shown positioned along the length of the top end 120 of the housing member 112. A slot 158 is contained within the housing member 112 and passes from the open area which contains the tape roll 116 to the bottom of the first end 136 of the tapered trough 118 in order to access for the tape to the tapered trough 118. A tape guide member 160 is positioned within the housing member directly under the tapered trough 118 and adjacent the slot 158. During use of the second embodiment of the two side taping apparatus 110, tape 162 is dispensed from the roll of tape 116 by being pulled with its adhesive side facing downward around the tape guide member 160, through the slot 158, onto the bottom of the first end 136 of the tapered trough 118 with its adhesive side facing upward, along the bottom of the tapered trough 118, through the pincher arms 140, and out through the second end 138 of the tapered trough 118.

Figure 22:
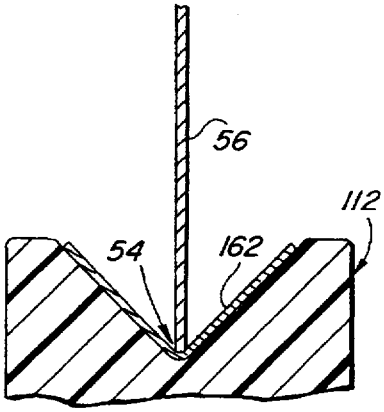
FIG. 22 is a cross-sectional view of the tapered trough shown in FIG. 21 taken along line 22—22 of FIG. 21.
Figure 21:
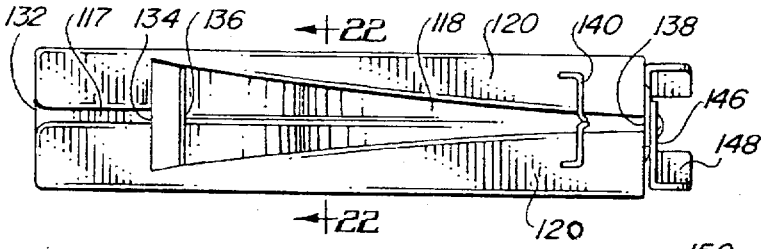
FIG. 21 is a top elevational view of the second preferred embodiment of the two side taping apparatus illustrated in FIG. 19 which shows the slit connected to the tapered trough that runs along the top length of the apparatus.

A top elevational view of the second embodiment of the two side taping apparatus 110 of the present invention is shown in FIG. 21. As can be seen from this view, the paper or thin object to be taped is inserted in the first end 132 of the slit 117 and then into the first end 136 of the tapered trough 118 and onto the adhesive side of the tape which lies in the bottom of the tapered trough 118. The paper is then pulled along toward the second end 138 of the tapered trough 118. FIG. 22 is a cross-sectional view of the tapered trough shown in FIG. 21 taken along line 22—22 of FIG. 21. Here the tapered trough is shown as being substantially "V" shaped.

The housing member 12,112 of the various embodiments of the two side taping apparatus of the present invention is preferably made from a hard plastic or polymeric material. The two sided taping apparatus of the present invention may be used with any conventional roll of tape. Varying colors of tape may be used to create filing and coding systems.

Further, it is contemplated that this invention may be automated by providing a motorized type of mechanism for moving the paper or object and tape along through the slit and tapered trough. Also, a larger industrial model of this invention is contemplated wherein the invention is completely automated for mass production of objects which are taped on opposing sides using one length of tape.

While the invention has been described and disclosed with reference to the preferred embodiments thereof, those skilled in the art will understand and appreciate that variations in the basic design and substitution of materials may be made, but still fall within the intended scope of the invention, which is to be limited only by the claims appended hereto.

I claim:

1. A two side taping apparatus for simultaneously taping opposing sides of an object around an edge of the object comprising:

a housing member;

means for releasably engaging a roll of tape within said housing member; and a tapered trough associated with said housing member such that a tape from said tape roll can be dispensed along a length of said tapered trough wherein said tapered trough is vertically positioned parallel to a length of said housing member and comprises a first end, a second opposite end, and a width which is uniformly narrowed from said first end to said second opposite end along the length of said tapered trough.

2. The two side taping apparatus of claim 1 further comprising a pair of pinch roller assemblies positioned within at least a portion of said tapered trough near a narrowmost width of said tapered trough.

3. The two side taping apparatus of claim 1 further comprising a pair of pincher arms positioned within at least a portion of said tapered through near a narrowmost width of said tapered trough.

4. The two side taping apparatus of claim 1 further comprising a rounded guide member located between the tape roll and the tapered trough for guiding the tape from the tape roll to the tapered trough.

5. The two side taping apparatus of claim 1 wherein said housing member includes a slot therethrough for feeding the tape from the tape roll to the tapered trough.

6. The two side taping apparatus of claim 1 further comprising means for cutting said tape located at the narrowmost end of said tapered trough.

7. The two sided taping apparatus of claim 6 wherein said means for cutting said tape comprises at least one row of teeth.

8. The two sided taping apparatus of claim 6 wherein said means for cutting said tape comprises at least one blade member.

9. The two side taping apparatus of claim 1 further comprising a narrow slot which opens into and is continuous with said first end of said tapered trough.

10. The two side taping apparatus of claim 1 wherein said housing member comprises a top end, a bottom end, a front side, a back side, and opposing side ends wherein said ends and sides form an open area wherein said means for releasably engaging a roll of tape is located.

11. The two side taping apparatus of claim 10 wherein said front side includes an opening of a sufficient size to accommodate the placement and removal of the tape roll within the open area.

12. The two side taping apparatus of claim 1 further comprising a base member wherein at least one of a side and end of said housing member is secured to said base member to stabilize said apparatus.

13. The two side taping apparatus of claim 12 wherein said base member comprises a uniquely formed detent for receiving said at least one of a side and end of said housing.

14. The two side taping apparatus of claim 1 further comprising a clamping apparatus and means for associating said clamping apparatus with said housing member such that said two side taping apparatus is capable of being secured and stabilized against a planar surface.

15. The two side taping apparatus of claim 1 further comprising means for storing a second roll of tape within said housing member.

16. An apparatus for simultaneously taping opposing sides of a thin planar around an edge of said thin planar or object comprising:

a housing member having a top end, a bottom end, two opposing side ends, a front side, and a back side;

a tapered trough member vertically positioned parallel to a length of said housing member wherein said tapered trough member is formed within the top end of said housing member and comprises a first end, a second opposite end, and a width which is uniformly narrowed from said first end to said second opposite end along a length of said tapered trough member;

means for releasably engaging a roll of tape within an interior of said housing member; and means for feeding a tape dispensed from said tape roll to said tapered trough member.

17. The apparatus of claim 16 further comprising a narrow slot which opens into and is continuous with said first end of said tapered trough.

18. The apparatus of claim 16 wherein said means for feeding the tape from the tape roll to the tapered trough member comprises a rounded guide member positioned within an interior of said housing beneath said tapered trough member and a slot passing from the interior of the housing to a bottom surface of said tapered trough member at the first end of said tapered trough member.

19. The apparatus of claim 16 wherein said means for releasably engaging a tape roll comprises:

first and second arm members each having first and second ends wherein said first ends are secured to, and extend horizontally from, said back side of said housing member into the interior of said housing member; and first and second end members attached to the second ends of said first and second arm members, respectively, wherein said first and second end members extend in opposite directions from said second ends of said first and second arm members thereby forming small "L" shaped hooks for retaining said tape roll.

20. The apparatus of claim 16 further comprising a base member wherein at least one of a side and end of said housing member is secured to said base member to stabilize said apparatus.

21. The apparatus of claim 16 further comprising a clamping apparatus and means for associating said clamping apparatus with said housing member such that said two side taping apparatus is capable of being secured and stabilized against a planar surface.

22. A method for simultaneously taping opposing sides of a thin planar object around an edge of said thin planar object comprising the steps of:

a) feeding tape from a tape roll onto a bottom surface of a tapered trough such an adhesive side of said tape is facing upward in said tapered trough;

b) positioning a front edge of said thin planar object onto the adhesive side of said tape lying on the bottom surface of said tapered trough;

c) advancing the edge of the thin planar object and the tape along the length of the tapered trough such that the object and tape are moving toward a narrowmost end of the tapered trough;

d) pulling the object and accompanying tape through a pair of pinch roller assemblies located near the narrowmost end of said tapered trough; and e) clearing the object and accompanying tape from the taping apparatus by advancing the object past the narrowmost end of the tapered trough.

23. The method of claim 22 further comprising the step of cutting the tape near an end of the object by pressing the tape against a row of teeth positioned at the narrowmost end of the tapered trough.

* * * * *